US010811777B1

(12) United States Patent
Fuchi et al.

(10) Patent No.: US 10,811,777 B1
(45) Date of Patent: Oct. 20, 2020

(54) DEPLOYABLE ORIGAMI ANTENNA ARRAY WITH TUNABLE DIRECTIVITY

(71) Applicant: Government of the United States, as represented by the Secretary of the Air Force, Wright-Patterson AFB, OH (US)

(72) Inventors: Kazuko Fuchi, Dayton, OH (US); Steven R. Seiler, Carlisle, PA (US); Giorgio Bazzan, Oakwood, OH (US); Philip R. Buskohl, Beavercreek, OH (US); Gregory W. Reich, Bellbrook, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 167 days.

(21) Appl. No.: 15/948,073

(22) Filed: Apr. 9, 2018

Related U.S. Application Data

(60) Provisional application No. 62/500,844, filed on May 3, 2017.

(51) Int. Cl.
*H01Q 9/04* (2006.01)
*H01Q 11/14* (2006.01)
*H01Q 1/36* (2006.01)

(52) U.S. Cl.
CPC ..... *H01Q 11/14* (2013.01); *H01Q 1/36* (2013.01); *H01Q 9/0414* (2013.01)

(58) Field of Classification Search
CPC ..... H01Q 11/14; H01Q 9/0414; H01Q 1/36
See application file for complete search history.

(56) References Cited

U.S. PATENT DOCUMENTS 3,836,979 A 8/1974 Kurland et al.
3,978,489 A 8/1976 Kurland et al.
(Continued)

FOREIGN PATENT DOCUMENTS

JP 2633587 B2 7/1997
JP 4285692 B2 6/2009
WO 2016141264 A1 9/2016

OTHER PUBLICATIONS

Lee, N., et al., "Multi-Layered Membrane Structures with Curved Creases for Smooth Packaging and Deployment," California Institute of Technology, American Institute of Aeronautics and Astronautics, 20 pages, Jan. 13, 2014.
(Continued)

*Primary Examiner* — Awat M Salih
(74) *Attorney, Agent, or Firm* — AFMCLO/JAZ; Timothy Barlow

(57) ABSTRACT

An antenna array including a foldable substrate having a plurality of fold lines arranged in a Miura-ori folding pattern, and a plurality of antenna elements interconnected by an electrical trace and disposed on the substrate, wherein the substrate containing the plurality of antenna elements is to fold according to a one-step Miura-ori folding pattern sequence, and wherein the plurality of antenna elements directs an antenna beam with a range of directivities caused by a folding of the substrate according to the one-step Miura-ori folding pattern sequence. The plurality of antenna elements may be non-overlapping prior to the folding of the substrate. The antenna beam may include a tunable radiation pattern that changes based on various stages of folding of the substrate containing the plurality of antenna elements.

19 Claims, 14 Drawing Sheets

(56) References Cited

U.S. PATENT DOCUMENTS

| | | | | |
|---|---|---|---|---|
| 5,091,732 | A | 2/1992 | Mileski et al. | |
| 5,196,857 | A | 3/1993 | Chiappetta et al. | |
| 5,864,324 | A | 1/1999 | Acker et al. | |
| 6,791,510 | B2 | 9/2004 | Watanabe et al. | |
| 7,126,553 | B1 | 10/2006 | Fink et al. | |
| 8,059,049 | B2 | 11/2011 | Quan et al. | |
| 9,214,722 | B2 | 12/2015 | Georgakopoulos et al. | |
| 9,706,646 | B2 | 7/2017 | Jiang et al. | |
| 9,735,474 | B2 | 8/2017 | Shmuel | |
| 2006/0043199 | A1* | 3/2006 | Baba | G06K 19/07749 235/492 |
| 2014/0340275 | A1* | 11/2014 | Georgakopoulos | H01Q 1/36 343/834 |
| 2016/0231784 | A1* | 8/2016 | Yu | G02F 1/133305 |
| 2016/0376037 | A1 | 12/2016 | Pellegrino et al. | |
| 2017/0025748 | A1* | 1/2017 | Georgakopoulos | H01Q 1/08 |
| 2017/0269188 | A1* | 9/2017 | Harne | G10K 11/32 |
| 2018/0072014 | A1* | 3/2018 | Dudte | B31D 5/04 |
| 2018/0278200 | A1* | 9/2018 | Jeon | F16M 11/2085 |

OTHER PUBLICATIONS

Hussain,S., et al., "Transformation from a Single Antenna to a Series Array Using Push/Pull Origami," Sensors, vol. 17, pp. 1968-1975, Aug. 26, 2017.

Lebée, A., "From Folds to Structures, a Review," International Journal of Space Structures, Multi Science Publishing, 2015, 30 (2), pp. 55-74, Feb. 7, 2015.

Turner, N., et al., "A Review of Origami and its Applications in Mechanical Engineering," Undergraduate Library Research Award Essay, University of Notre Dame, 29 pages, May 12, 2015.

Yao. S., et al.,"Deployable Origami Yagi Loop Antenna," 2015 IEEE International Symposium on Antennas and Propagation & USNC/URSI National Radio Science Meeting, Jul. 2015, pp. 2215-2216.

Yao, S., et al., "A Novel Reconfigurable Origami Accordion Antenna," Proceedings of the EEE/RSJ International Conference on Intelligent Robots and Systems, Chicago, IL, USA, 2014, pp. 14-18.

Knight, B., "Deployable antenna kinematics using tensegrity structure design," Dissertation for Doctor of Philosophy Degree, University of Florida, 2000, 114 pages.

Liu, X., et al., "Reconfigurable Helical Antenna Based on an Origami Structure for Wireless Communication System," Microwave Symposium (IMS), 2014 IEEE MTT-S International, 2014, pp. 1-4.

Yao, S., et al., "A Novel Reconfigurable Origami Spring Antenna," Antennas and Propagation Society International Symposium (APSURSI), 2014 IEEE, 2014, pp. 374-375.

Guest, S., et al., "A new concept for solid surface deployable antennas," Acta Astronautica, vol. 38, pp. 103-113, 1996.

* cited by examiner 70
10
20
32
32
32
32
35
25
12
30
15
40
50
50
50
31
31
31
60
16
65
15
16
20
35
30
30
45
45

— · · — $\beta = 0°$
— — — $\beta = 10°$
——— $\beta = 30°$
- - - - - $\beta = 60°$ L
214
Selectively configuring an angle of the crease lines with respect to one another
200

M
216
Directing the antenna beam from the array of antenna elements attached to a vehicle
200

N
218
Directing the antenna beam from the array of antenna elements attached to a satellite
200

DEPLOYABLE ORIGAMI ANTENNA ARRAY WITH TUNABLE DIRECTIVITY

CROSS-REFERENCE TO RELATED APPLICATION(S)

This application claims the benefit of U.S. Provisional Patent Application No. 62/500,844 filed on May 3, 2017, which is incorporated herein by reference in its entirety.

GOVERNMENT INTEREST

The invention described herein may be manufactured and used by or for the Government of the United States for all government purposes without the payment of any royalty.

BACKGROUND

Field of the Invention

The embodiments herein generally relate to antennas, and more particularly to deployable origami-based antennas.

Background of the Invention

Increasing performance and size reduction requirements necessitate antenna designs with multiple operating configurations. Size reduction is particularly emphasized in space applications and military operations where portability of the device is crucial. Currently existing deployable antennas based on large truss, tensegrity and tension structures, and inflatable systems achieve portability in their stowed configurations and intended operations when fully deployed. However, the operation is assumed in a static, deployed state without leveraging the performance potentials of intermediate configurations.

This results in deployable antennas that are particularly advantageous in one aspect but limiting in another. For example, a parabolic reflector antenna achieves a very high gain in one direction, but the narrow beam width requires a physical turning of a large structure when an off-angle radiation is necessary. Exceptions to this are seen in origami-based helical and spiral antennas that are deployable and tunable in their operating frequencies through folding cylindrical/tubular spring/accordion-like origami patterns. The limitations of these designs, however, are the added manufacturing complexity and weight. For instance, some origami helical antenna designs assume the deposition of conductive traces on a flat substrate and folding the substrate into a cylinder-like, 3D origami pattern for its deployed, operational state, while a conventional helical antenna may be made by winding a wire around a rod. Furthermore, the hosting substrate required by the origami helical antenna adds to the total weight of the antenna.

BRIEF SUMMARY OF THE INVENTION

In view of the foregoing, an embodiment herein provides an antenna array comprising a foldable substrate comprising a plurality of fold lines arranged in a Miura-ori folding pattern; and a plurality of antenna elements interconnected by an electrical trace and disposed on the substrate, wherein the substrate containing the plurality of antenna elements is to fold according to a one-step Miura-ori folding pattern sequence, and wherein the plurality of antenna elements directs an antenna beam with a range of directivities caused by a folding of the substrate according to the one-step Miura-ori folding pattern sequence. The plurality of antenna elements may be non-overlapping prior to the folding of the substrate. The antenna beam may comprise a tunable radiation pattern that changes based on various stages of folding of the substrate containing the plurality of antenna elements. The plurality of antenna elements may be arranged in a predetermined array configuration that is selectively articulated in a continuous motion between a stowed configuration and a deployed configuration according to the Miura-ori folding pattern sequence. The plurality of antenna elements may be planar in the deployed configuration. The plurality of antenna elements may be incompressible.

Another embodiment provides a method of performing electrical beamforming of an antenna, the method comprising disposing a plurality of conductive antenna elements on a foldable substrate to provide an antenna array; radiating an antenna beam from the antenna array; and articulating the foldable substrate into one of at least four positions according to a Miura-ori origami folding pattern sequence to control an antenna beam being radiated by the antenna array. The frequency of the antenna beam may be constant. A surface area of a fully folded configuration of the antenna array may be at least 70% less than the surface area of a fully deployed configuration of the antenna array. In other words, the stowed area may be approximately ⅓ of the deployed area. The method may comprise changing an output radiation pattern of the antenna beam based on the Miura-ori origami folding pattern sequence. The method may comprise actuating the Miura-ori origami folding pattern sequence using an actuator. The method may comprise folding the substrate containing the antenna array in a single degree of freedom motion.

Another embodiment provides a method of controlling an antenna beam, the method comprising providing an array of antenna elements on a foldable substrate containing crease lines; and folding the substrate containing the array of antenna elements along crease lines according to a one-step Miura-ori folding pattern sequence, wherein the folding changes an output radiation pattern of an antenna beam radiated from the array of antenna elements. The method may comprise folding the substrate into one of at least four positions. The method may comprise arranging a predetermined number of arrays of antenna elements on the substrate. The method may comprise folding the substrate in a continuous set of operating stages based on the Miura-ori folding. The method may comprise directing the antenna beam with a range of directivities caused by a changing configuration of the array of antenna elements based on the Miura-ori folding pattern sequence. The method may comprise selectively configuring an angle of the crease lines with respect to one another. The method may comprise directing the antenna beam from the array of antenna elements attached to a vehicle. The method may comprise directing the antenna beam from the array of antenna elements attached to a satellite.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF THE INVENTION

Figures 1A, 1B, 1C, 1D:
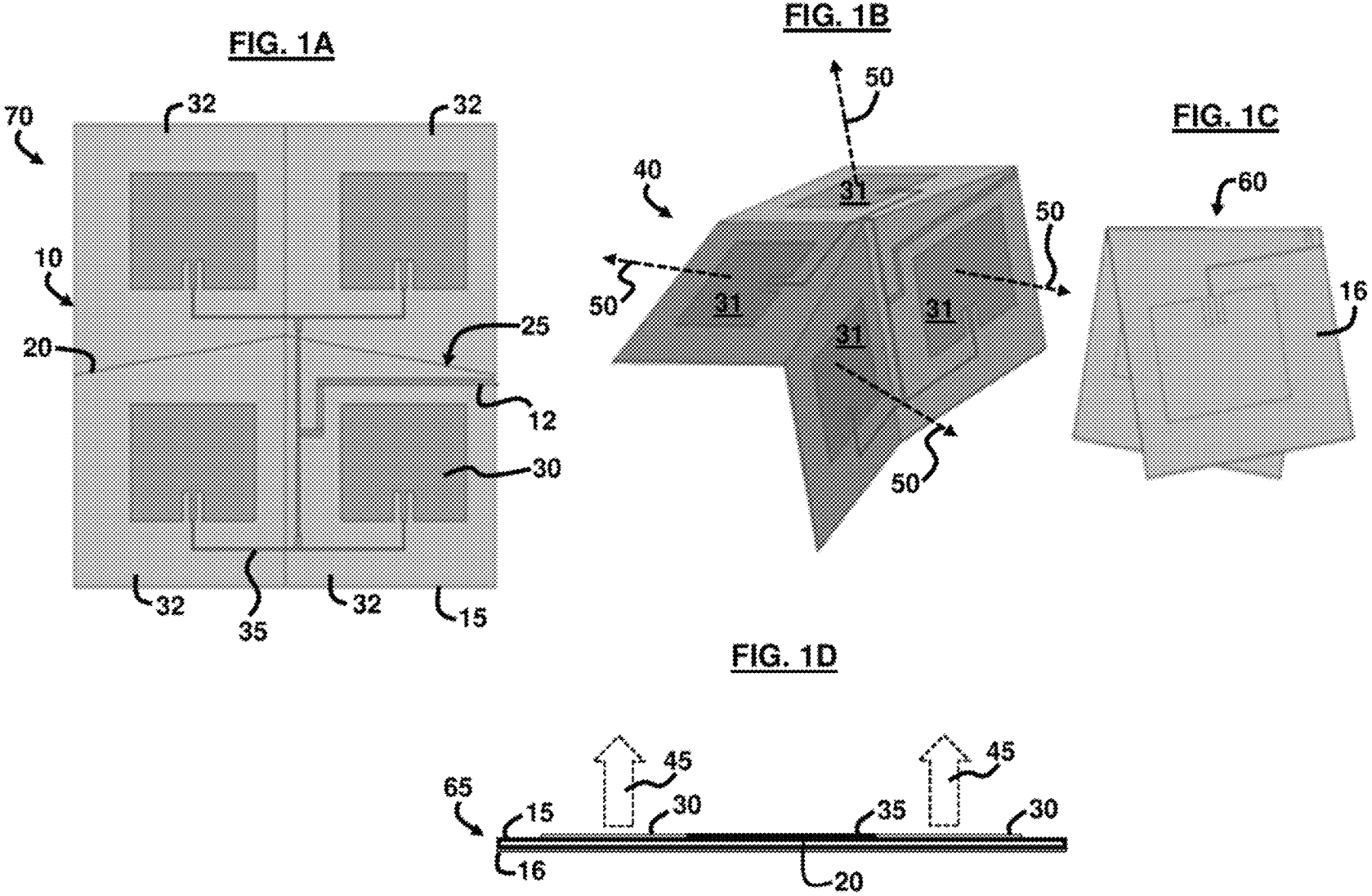
FIG. 1A is a schematic diagram illustrating a top view of an antenna array in a fully deployed configuration, according to an embodiment herein.
FIG. 1B is a schematic diagram illustrating the antenna array of FIG. 1A in a partially-folded configuration, according to an embodiment herein.
FIG. 1C is a schematic diagram illustrating the antenna array of FIG. 1A in a fully-folded configuration, according to an embodiment herein.
FIG. 1D is a schematic diagram illustrating a side view of the antenna array of FIG. 1A in a fully deployed configuration, according to an embodiment herein.

Embodiments of the disclosed invention, its various features and the advantageous details thereof, are explained more fully with reference to the non-limiting embodiments that are illustrated in the accompanying drawings and detailed in the following description. Descriptions of well-known components and processing techniques are omitted to not unnecessarily obscure what is being disclosed. Examples may be provided and when so provided are intended merely to facilitate an understanding of the ways in which the invention may be practiced and to further enable those of skill in the art to practice its various embodiments. Accordingly, examples should not be construed as limiting the scope of what is disclosed and otherwise claimed.

In the drawings, the size and relative sizes of layers and regions may be exaggerated for clarity. Antennas that achieve high deployability and multi-functionality with tunable directivity are desirable. While the performance space expands as the number of antenna units increases, the size of the device multiplies quickly. To address this, the embodiments herein provide a deployable and tunable patch array antenna based on the Miura-ori origami fold pattern that achieves controllable directivity. The antenna contains a thin dielectric substrate with a patch antenna printed on each facet and interconnected by conductive traces into an antenna array. The substrate is backed by a conductive film acting as a ground plane. The length of each patch is specified to approximately one half of the wavelength that corresponds to the operating frequency.

An N×M array of patch antennas are laid out in a uniform grid in the deployed, flat state, with a half wavelength spacing between adjacent patches. Fold lines are provided in the space between the patch antennas keeping each antenna unperturbed on its hosting facet, such that the fold lines match the Miura-ori fold pattern. The range of motion of deployment of the patch antenna permits variable directivity of the output beam. The feed network is configured so that the impedance of the antenna matches the input impedance, and the number of locations where conductive traces cross over fold lines is minimized. In the stowed state, the antenna is folded into another flat state, achieving a surface area reduction compared to the fully deployed state for a 2×2 array with increasing reduction for larger arrays. Referring now to the drawings, and more particularly to FIGS. 1A through 8H where similar reference characters denote corresponding features consistently throughout, there are shown exemplary embodiments.

FIGS. 1A through 1D illustrate an antenna 70 arranged as an antenna array 10 according to an embodiment herein. The examples shown in FIGS. 1A through 1D depict a 2×2 antenna array 10. However, other configurations following a M×N row/column pattern are possible in accordance with the embodiments herein, where M and N are positive integers. As shown in FIG. 1A, the antenna array 10 comprises a foldable substrate 15 comprising a plurality of fold (e.g., crease) lines 20 arranged in a Miura-ori folding pattern 25. In an example, the substrate 15 may comprise a thin dielectric substrate 15. In other examples, the substrate 15 may comprise plastic or other polymer materials. For example, the antenna array 10 may be configured with an approximately 0.75 mm thick polypropylene substrate 15. In some examples the substrate 15 may be rigid, while in other examples the substrate 15 may be flexible. The particular application for which the antenna array 10 is to be used will dictate whether it is desirable to have a rigid or flexible substrate 15. In some examples, the rigidity or flexibility of the substrate 15 may be configured by increasing or decreasing the thickness of the substrate 15, by the choice of material of the substrate 15, or by the addition of additional base layers/films 16 (shown in FIG. 1D) to the back of the substrate 15, etc.

A plurality of antenna elements 30 are interconnected by an electrical trace 35 and disposed on the substrate 15. In an example, the electrical trace 35 may be 100Ω feed lines, although other resistive parameters may be utilized in accordance with the embodiments herein. In some examples, the electrical trace 35 may be configured as sectional feed lines electrically connected together. An electrical feedline 12 is provided to input power to the plurality of antenna elements 30 through the electrical trace 35. In an example, the plurality of antenna elements 30 comprise an electrically conducting material, such as copper, which may be configured in a suitable shape, such as rectangular, etc. In one example, each antenna element 30 may be dimensioned to be approximately (length×width) 47.5 mm×40.7 mm, although other shapes and dimensions are possible.

The substrate 15 containing the plurality of phased antenna elements 30 is to fold according to a one-step Miura-ori folding pattern sequence 40. The embodiments herein utilize the Miura-ori origami method of folding a flat surface such as the substrate 15 into a smaller, compact area (as shown in the stowed configuration 60 of FIG. 1C). The Miura-ori folding pattern sequence 40 is a form of a single degree of freedom rigid origami. In this regard, the Miura-ori folding pattern sequence 40 can be carried out by a continuous motion as opposed to a step-wise motion with discrete or staggered steps requiring cessation of the motion of the folding sequence. As such, the plurality of antenna elements 30 may be arranged in a predetermined array (M×N) configuration that is selectively articulated in a continuous motion between a stowed configuration 60 (of FIG. 1C) and a deployed configuration 65 (of FIGS. 1A and 1D) according to the Miura-ori folding pattern sequence 40.

As shown in FIGS. 1B and 1D, the plurality of antenna elements (i.e., conductive patches) 30 directs an antenna beam 45 with a range of directivities 50 caused by a folding of the substrate 15 according to the one-step Miura-ori folding pattern sequence 40. The antenna beam 45 is outwardly directed from each of the antenna elements 30 such that the antenna beam 45 is normal to the surface 31 of the antenna elements 30. As used herein, the term directivity refers to a measure of how directional the antenna radiation pattern is. The antenna array 10 is configured as a patch antenna array, which achieves high directivity and electrical beamforming by spacing the antenna elements 30 apart so that they are not overlapping. More particularly, the electrical beamforming comes from constructive interference between each antenna element 30. This arises when the antenna elements 30 are spaced to a specific amount and is dependent on operating frequency (and the corresponding wavelength).

Accordingly, in one example as shown in FIG. 1A, the plurality of antenna elements 30 may be non-overlapping prior to the folding of the substrate 15. As shown in FIGS. 1C and 1D, the substrate 15 is backed by a conductive film 16 acting as a ground plane. Furthermore, the additional base layers/films (not shown) could also be useful in multiple layer locations (e.g., back of the substrate 15, back of a conductive film 16, front of the substrate 15, below the antenna elements 30, or above the antenna elements 30, etc.). This way the antenna array 10 could be fully coated (e.g., providing for waterproofing functionality) or intermediate layers could allow better adhesion of antenna elements 30 to the substrate 15, for example. The conductive material of the antenna elements 30 and the conductive material of the conductive film 16 jointly create a resonant electromagnetic transmission line having a length of approximately one-half wavelength of the radio frequency waves. In an example, the thickness of the antenna array 10 inclusive of the substrate 15, conductive film 16, and antenna element 30 may be approximately 10-20 nm, although other thicknesses may be possible. The plurality of antenna elements 30 on the substrate 15 create a phased array 10, which allow the antenna beam 45 to be altered through folding of the substrate 15.

Accordingly, as shown in FIG. 1A, the plurality of antenna elements 30 are configured as interconnected antenna elements 30 printed on each facet 32 of the antenna array 10. In an example, each facet may have an average length and width of approximately 6 cm, although other configurations and dimensions are possible. The length of each antenna element 30 is specified to approximately one half of the wavelength that corresponds to the operating frequency of the antenna array 10. An M×N array of antenna elements 30 are laid out in a uniform grid in the deployed, flat state, with a half wavelength spacing between adjacent facets 32. The fold lines 20 are positioned in the space between the antenna elements 30 keeping each antenna element 30 unperturbed on its respective hosting facet 32.

Only the electrical traces 35 extend across the fold lines 20; the antenna elements 30 do not extend across the fold lines 20.

In FIG. 1D, the plurality of antenna elements 30 are shown to be planar in the deployed configuration 65. The planar arrangement of the antenna elements 30 allow for a more uniform Miura-ori folding pattern sequence 40 to allow the antenna array 10 to transition into the stowed configuration 60 in as much a compact manner as practical. The origami deployable patch antenna array 10 can be folded into 110-120% of the single patch antenna in the stowed configuration 60 and unfolded through a single degree of freedom motion to its deployed configuration 65.

Furthermore, the planar arrangement of the antenna elements 30 allows for ease in fabrication of the antenna array 10, wherein the antenna elements 30 may be similarly configured and applied to the substrate 15 in a uniform manner without requiring additional manufacturing steps to create multi-level antenna elements. In an example, the plurality of antenna elements 30 may be incompressible. In this regard, contrary to a helical or spring/accordion-like structure, the antenna array 10 is substantially flat, and the rigidity of the antenna elements 30 attached to the substrate 15 provide for an incompressible structure of the antenna elements 30.

Figure 2A:
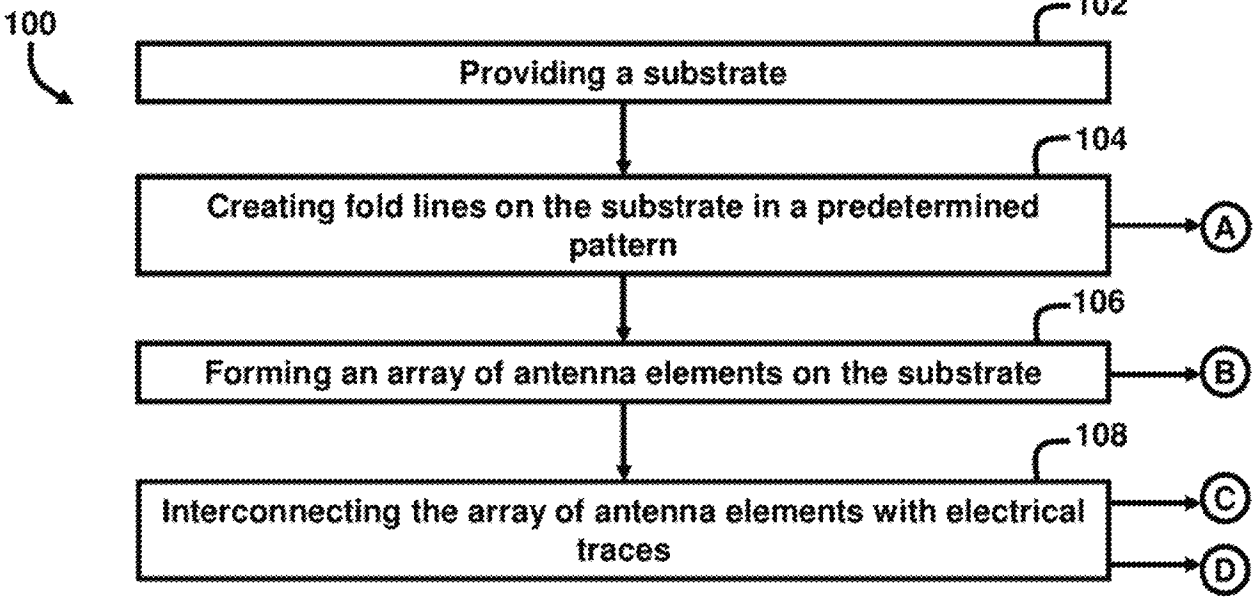
FIG. 2A is a flow diagram illustrating a method of forming the antenna array of FIG. 1A, according to an embodiment herein.

FIGS. 2A through 2E, with reference to FIGS. 1A through 1D are flow diagrams illustrating a method 100 of forming an antenna array 10. As shown in FIG. 2A, the method comprises providing (102) a substrate 15. The substrate 15 may be a flat dielectric substrate. The method 100 further comprises creating (104) fold lines 20 on the substrate 15 in a predetermined pattern; forming (106) an array 10 of antenna elements 30 on the substrate 15; and interconnecting (108) the array 10 of antenna elements 30 with electrical traces 35, wherein the predetermined pattern follows a Miura-ori folding pattern sequence 40, and wherein the folding permits an output radiation pattern from the array 10 of antenna elements 30 to be tunable. The antenna elements 30 may be flexible or rigid and may be formed on the substrate 15 using deposition and other additive manufacturing techniques, as well as laser-etching or material lift-off techniques.

Figure 2B:
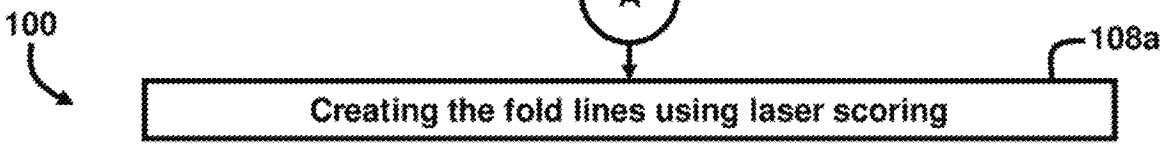
FIG. 2B is a flow diagram illustrating a method of creating fold lines on a substrate, according to an embodiment herein.
Figure 2C:
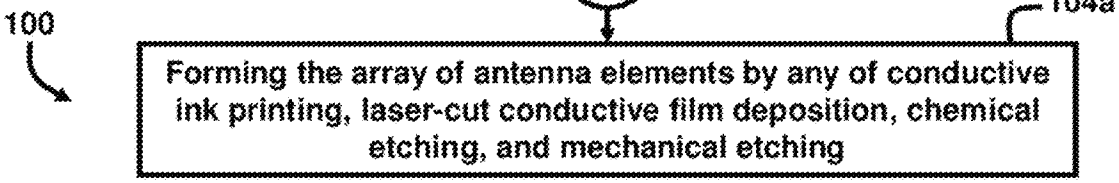
FIG. 2C is a flow diagram illustrating a method of forming an array of antenna elements using different manufacturing techniques, according to an embodiment herein.
Figure 2D:
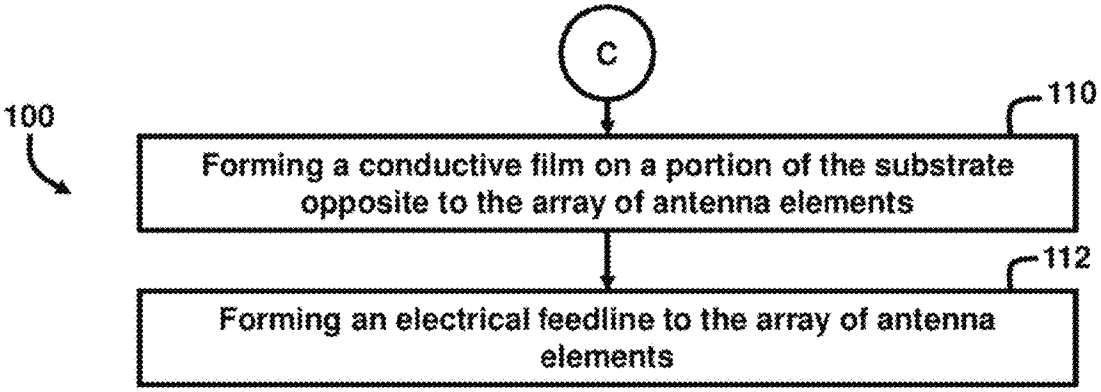
FIG. 2D is a flow diagram illustrating a method of forming a conductive film, according to an embodiment herein.
Figure 2E:
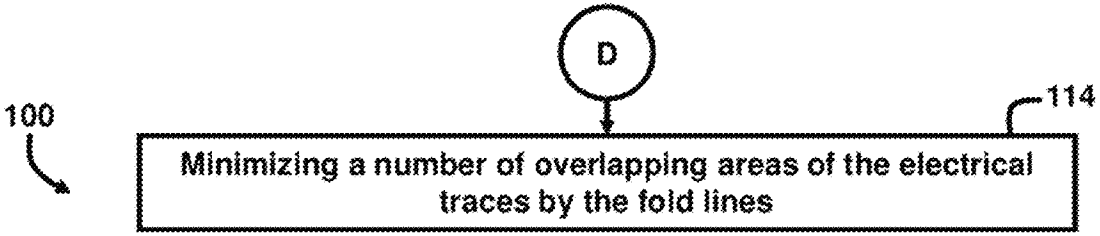
FIG. 2E is a flow diagram illustrating a method of minimizing the overlapping areas of electrical traces on a substrate, according to an embodiment herein.

As shown in FIG. 2B, the method 100 may comprise creating (108*a*) the fold lines 20 using laser scoring. In particular, the substrate 15 may be scored by laser ablation or perforated along the fold lines 20 to make the substrate 15 foldable. As shown in FIG. 2C, the method 100 may comprise forming (104*a*) the array 10 of antenna elements 30 while the substrate 15 is in its fully flat and deployed configuration 65 by any of conductive ink printing, laser-cut conductive film deposition, chemical etching, and mechanical etching. As shown in FIG. 2D, the method 100 may comprise forming (110) a conductive film 16 on a portion of the substrate 15 opposite to the array 10 of antenna elements 30 (e.g., backside of substrate 15); and forming (112) an electrical feedline 12 to the array 10 of antenna elements 30, which is configured to receive input power and provide the same to the electrical feedline 12 and conductive film 16. As shown in FIG. 2E, the method 100 may comprise minimizing (114) a number of overlapping areas of the electrical traces 35 by the fold lines 20 by selectively configuring an angle of the fold lines 20 with respect to one another.

Figure 3A:
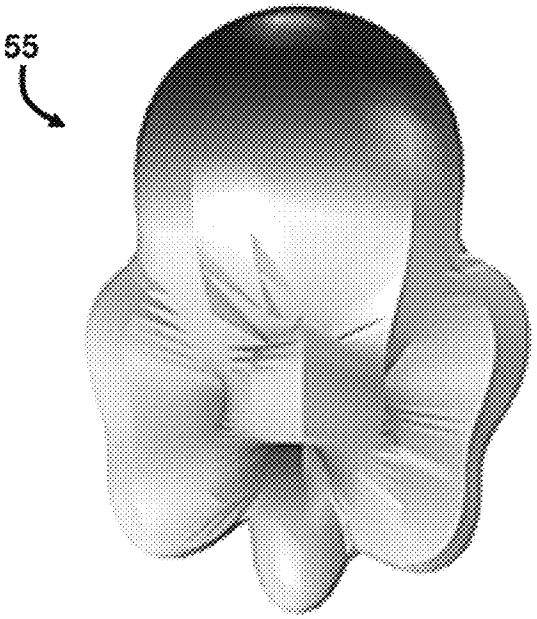
FIG. 3A is a simulated representation illustrating an antenna beam radiation pattern associated with an antenna array in a fully deployed configuration, according to an embodiment herein.
Figure 3B:
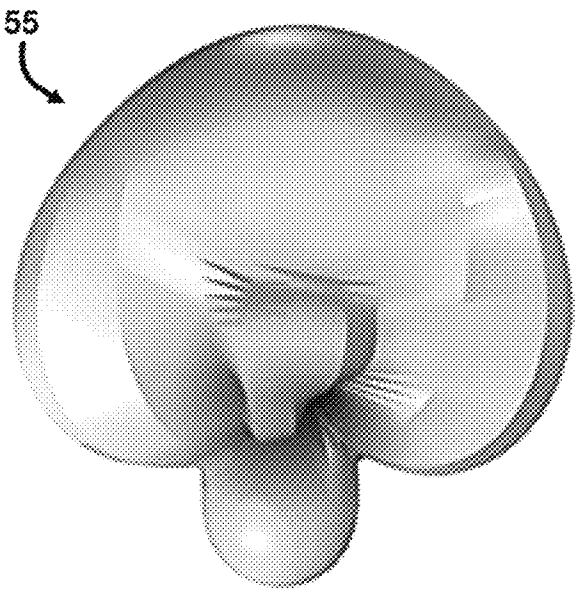
FIG. 3B is a simulated representation illustrating an antenna beam radiation pattern associated with an antenna array in a partially deployed configuration, according to an embodiment herein.

FIGS. 3A and 3B, with reference to FIGS. 1 through 2E, illustrated simulated radiation patterns 55 associated with the antenna beam 45. The antenna array 10 can be partially deployed allowing for control in the beam width of a radiation pattern 55. In a fully deployed configuration 65 (e.g., flat state), a high directivity of the antenna beam 45 is obtained, as demonstrated in the simulated radiation pattern 55 of the 2×2 antenna array 10 shown in FIG. 3A. When folded to a small angle, high directivity is maintained with the radiation pattern 55. When largely folded, the radiation pattern 55 becomes wide-spread, as shown in FIG. 3B. Accordingly, the antenna beam 45 may comprise a tunable radiation pattern 55 that changes based on various stages of folding of the substrate 15 containing the plurality of antenna elements 30.

Figure 4:
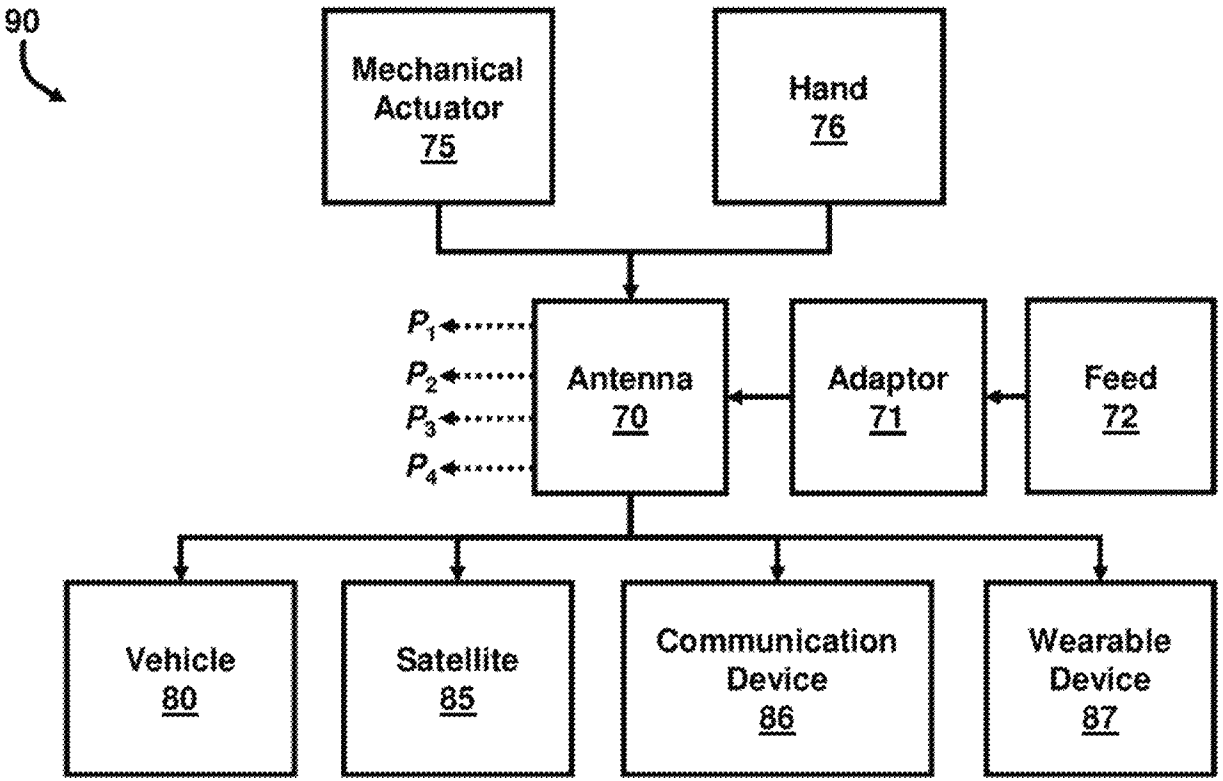
FIG. 4 is a block diagram illustrating a system, according to an embodiment herein.

FIG. 4, with reference to FIGS. 1A through 3B, is a block diagram illustrating a system 90 for controlling and utilizing an antenna 70, according to an embodiment herein. However, the antenna 70 may not necessarily be restricted to the configuration described with reference to the antenna array 10. The deployment and actuation of the antenna may be achieved by a single actuator. The single degree of freedom folding/unfolding motion of Miura-ori folding pattern sequence 40 allows for a simple deployment mechanism, leading to further space and weight reduction. For example, the antenna 70 can be deployed from a fully folded and stowed configuration 60 by a linear mechanical actuator 75 or by hand 76, according to some examples, although other types of deployment mechanisms may be utilized in accordance with the embodiments herein. Moreover, the antenna 70 may be attached to an object such as a vehicle 80 or a satellite 85, a communication device 86, or a wearable device 87, for example, such that the underlying surface to which the antenna 70 is attached may be planar or curved, and as such, the antenna 70 may be conformal to the underlying object to which it is attached.

The geometry and configuration of the antenna elements 30 and the electrical feedline 12 follows the standard patch antenna array design guidelines for high directivity and gain. The electrical feedline 12 (referred to as the "feed network") is configured so that the impedance of the antenna 70 matches the input impedance, and the number of locations where electrical traces 35 cross over fold lines 20 is minimized. As such, the configuration of the electrical feedline 12 can be applied to a larger array (e.g., larger than a 2×2 array) with more facets 32 (e.g., more than four facets 32 as shown in the drawings). An adaptor 71 such as a coaxial cable adaptor, for example, for the selected feed 72 is attached to the electrical feedline 12 and ground plane (e.g., conductive film 16) on the edge of the substrate 15.

The antenna 70 offers a range of operation modes and controllable directivity based on the at least four positions $P_1$-$P_4$, and further described as follows. In the first position $P_1$, the antenna 70 is in its flat and fully deployed configuration 65, and a high directivity of the antenna beam 45 is obtained due to the planar and optimally spaced configuration of the plurality of antenna elements 30. In an exemplary embodiment, the antenna 70 is fabricated in this flat and fully deployed configuration 65, enabling the use of conventional circuit board etching or printing techniques. The robust performance of the antenna 70 is demonstrated in a high directivity maintained through a small range of folding motion according to the Miura-ori folding pattern sequence 40. In the fourth position $P_4$, the antenna 10 is its fully folded and stowed configuration 60, whereby the antenna 10 achieves a maximized portability of the configuration of the antenna 10. In the intermediate positions $P_2$ and $P_3$, the antenna 10 is in a slightly folded position ($P_2$) and a largely folded position ($P_3$), whereby the radiation pattern 55 of the antenna beam 45 from the antenna 10 becomes wide-spread and is controllable through the extent of the fold.

The extent to what constitutes a "slightly" or "largely" folded position $P_2$, $P_3$ is a function of how much of the antenna 70 is folded, and directly effects the shape and directivity of the radiation pattern 55. In an example, position $P_2$ may be the antenna 70 folded between 0-49% compared to position $P_1$, and position $P_3$ may be the antenna 70 folded between 50-99% compared to the position $P_1$. Accordingly, the antenna 10 provides for a multi-functionality of its deployment, portability, surface area, and directivity of the antenna beam 45 through the at least four distinct configurations or positions $P_1$-$P_4$, however the transitions between the successive positions (i.e., from positions $P_1$ to $P_2$, or positions $P_2$ to $P_3$, or positions $P_3$ to $P_4$) may be continuous or may be selected to stop at a particular position based on the desired directivity of the antenna beam 45. However, the motion that occurs through in the Miura-ori folding pattern sequence 40 is considered to be continuous as opposed to being discrete. The four configurations (positions $P_1$-$P_4$) and their respective operations are summarized as:

$P_1$—flat and fully deployed configuration 65 for the nominal operation with a focused antenna beam 45.

$P_2$—slightly folded configuration with residual folds or conforming surface, with a slightly widened antenna beam 45.

$P_3$—largely folded configuration with a wide antenna beam 45 for broadcasting or signal search.

$P_4$—completely folded and stowed configuration 60 for portability.

Figure 5A:
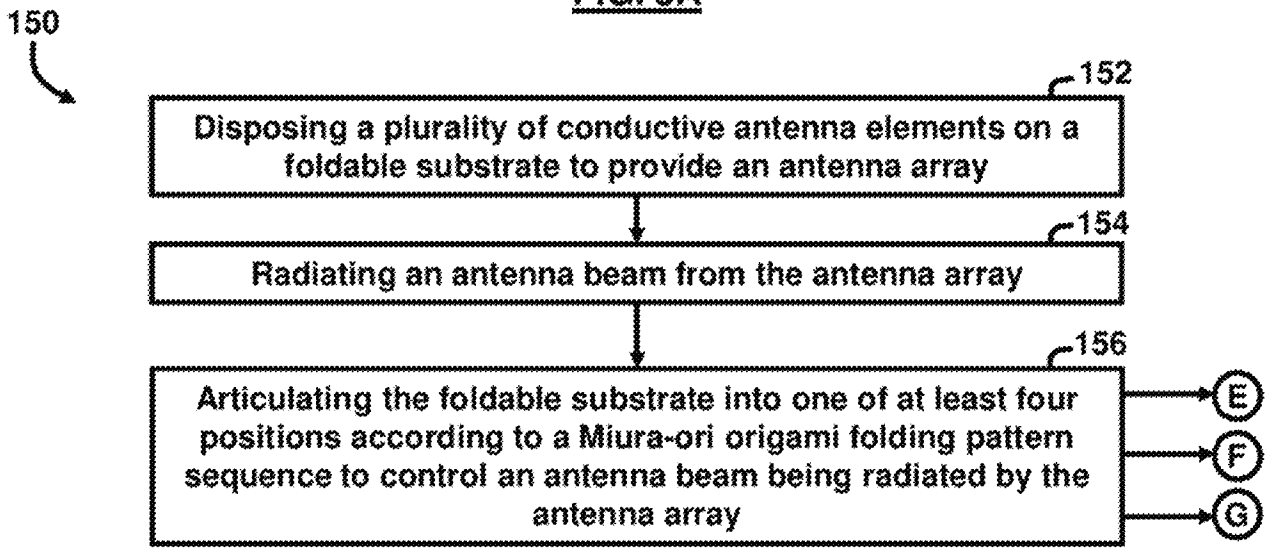
FIG. 5A is a flow diagram illustrating a first sequence of a method of performing electrical beamforming of an antenna, according to an embodiment herein.

FIGS. 5A through 5D, with reference to FIGS. 1A through 4 are flow diagrams illustrating a method 150 of performing electrical beamforming of an antenna 70. As shown in FIG. 5A, the method 100 comprises disposing (152) a plurality of conductive antenna elements 30 on a foldable substrate 15 to provide an antenna array 10; radiating (154) an antenna beam 45 from the antenna array 10; and articulating (156) the foldable substrate 15 into one of at least four positions $P_1$-$P_4$ according to a Miura-ori origami folding pattern sequence 40 to control an antenna beam 45 being radiated by the antenna array 10. The frequency of the antenna beam 45 may be constant. A surface area of a fully folded configuration of the antenna array 10 may be at least 70% less than the surface area of a fully deployed configuration 65 of the antenna array 10. In other words, the stowed surface area may be approximately ⅓ of the deployed surface area.

The embodiments herein are scalable from a small to a large antenna array 10, increasing the level of deployability and flexibility to conform to a curved surface of an underlying object (e.g., vehicle 80, satellite 85, etc.). In one example, a 2×2 array of antenna elements 30 with the surface area reduction to approximately 30% when in the stowed configuration 60 is provided. In another example, the size of the array 10 increases while also increasing the relative reduction in size for storage. For example, a surface area reduction of ~1/17 may be achieved for a 5×7 array. A larger array may also improve the flexibility of the overall antenna structure to conform to underlying curved surfaces, without compromising the controllability of folding/unfolding with a single degree of freedom motion if the substrate 15 is slightly flexible.

Figure 5B:
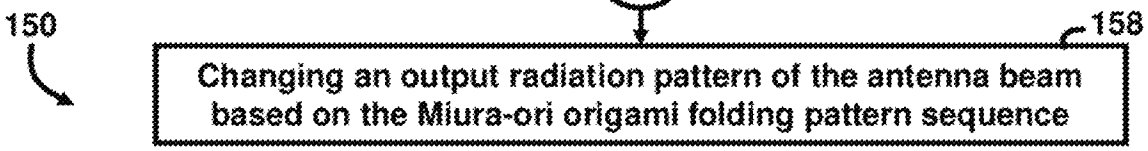
FIG. 5B is a flow diagram illustrating a method of changing an output radiation pattern of an antenna beam, according to an embodiment herein.
Figure 5C:
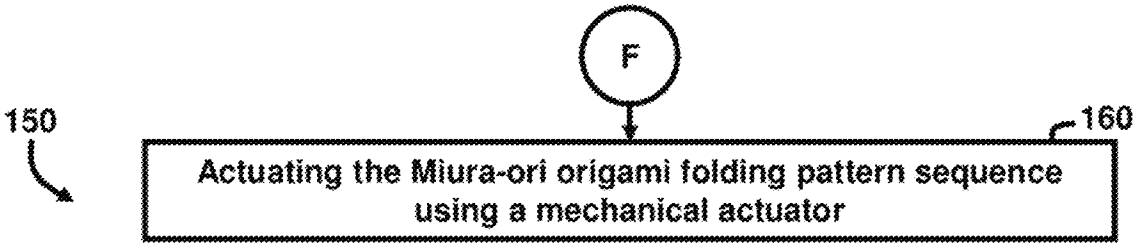
FIG. 5C is a flow diagram illustrating a method of actuating a Miura-ori origami folding pattern sequence, according to an embodiment herein.
Figure 5D:
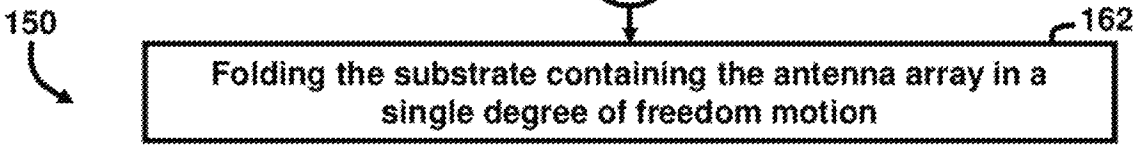
FIG. 5D is a flow diagram illustrating a method of folding a substrate containing an antenna array, according to an embodiment herein.

As shown in FIG. 5B, the method 150 may comprise changing (158) an output radiation pattern 55 of the antenna beam 45 based on the Miura-ori origami folding pattern sequence 40. As shown in FIG. 5C, the method 150 may comprise actuating (160) the Miura-ori origami folding pattern sequence 40 using an actuator 75. As shown in FIG. 5D, the method 150 may comprise folding (162) the substrate 15 containing the antenna array 10 in a single degree of freedom motion.

Figure 6A:
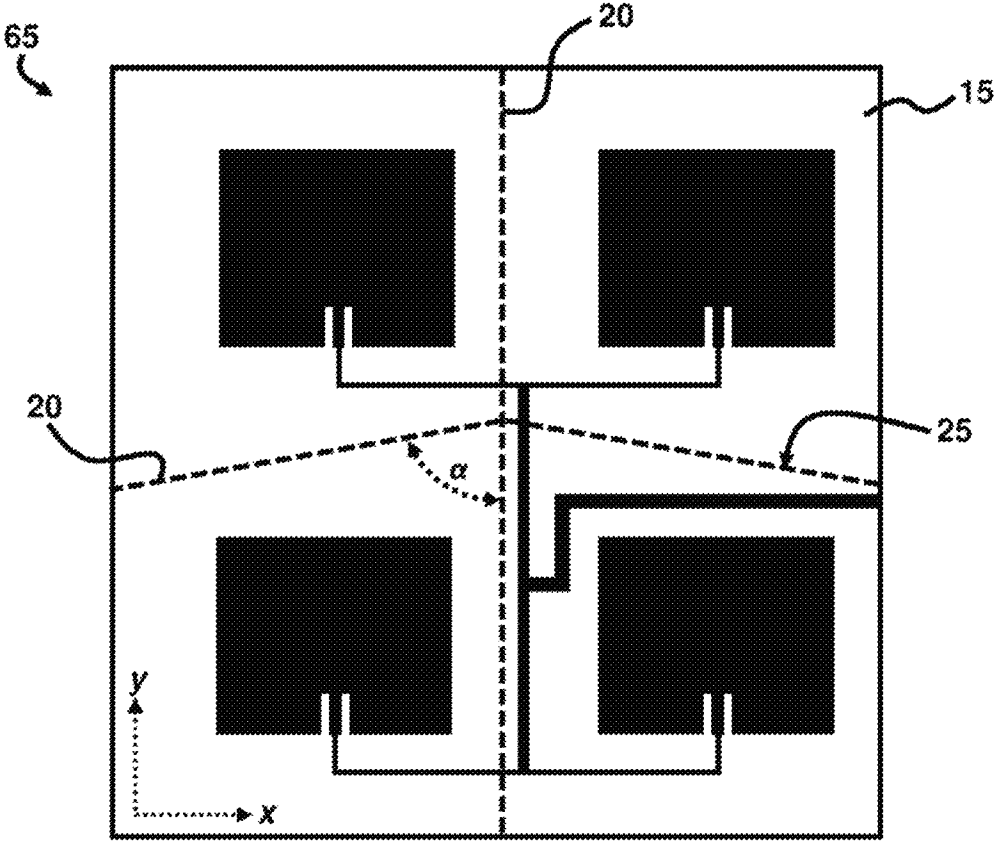
FIG. 6A is a schematic diagram illustrating a foldable antenna with a fold angle of 0°, according to an embodiment herein.
Figure 6C:
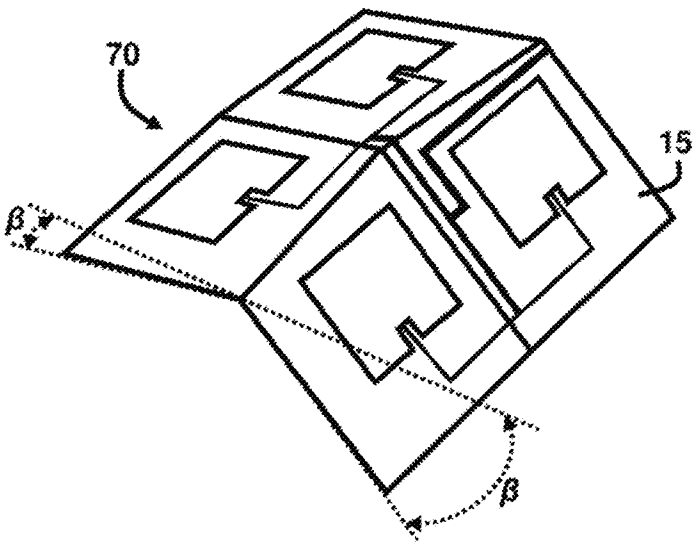
FIG. 6C is a schematic diagram illustrating a foldable antenna with a fold angle of 30°, according to an embodiment herein.
Figure 6B:
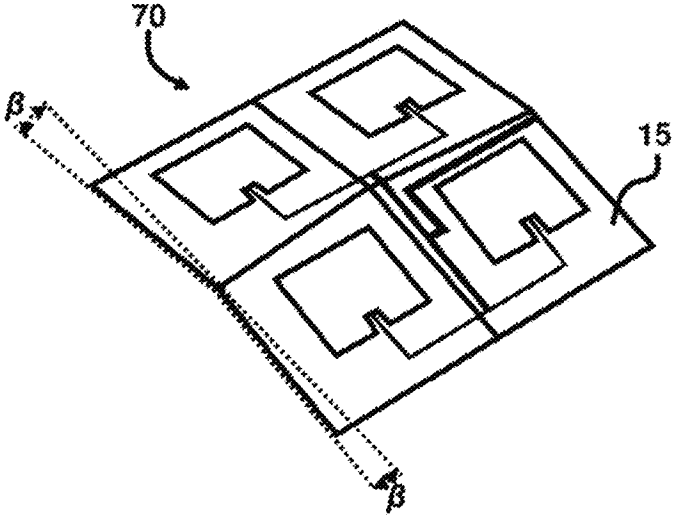
FIG. 6B is a schematic diagram illustrating a foldable antenna with a fold angle of 10°, according to an embodiment herein.
Figure 6E:
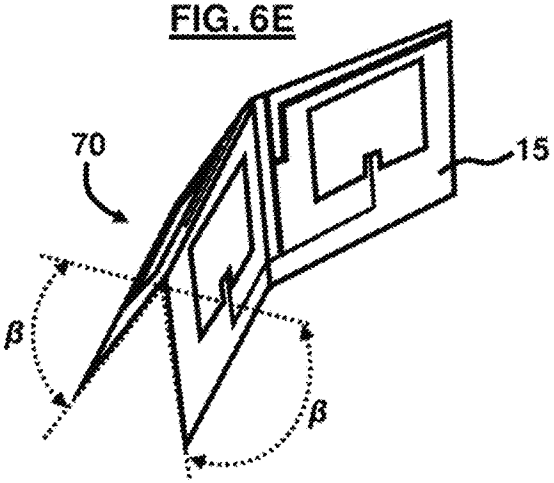
FIG. 6E is a schematic diagram illustrating a foldable antenna with a fold angle of 75°, according to an embodiment herein.
Figure 6D:
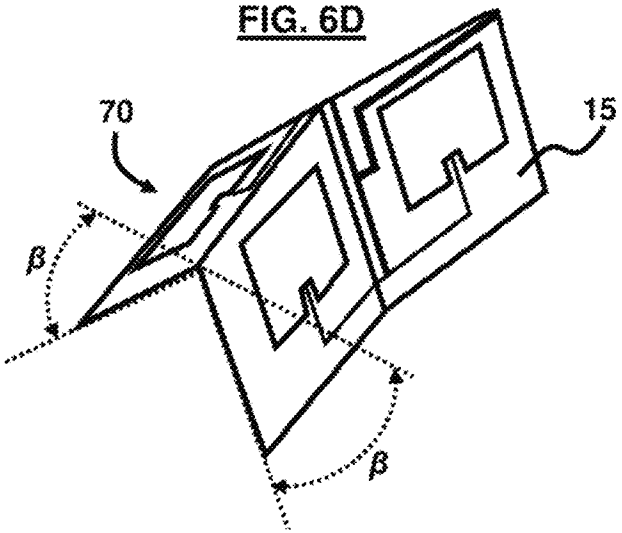
FIG. 6D is a schematic diagram illustrating a foldable antenna with a fold angle of 60°, according to an embodiment herein.

As shown in FIG. 6A, with reference to FIGS. 1A through 5D, the Miura-ori folding pattern 25 has an interior angle $\alpha$ with respect to the intersecting fold lines 20. In an example, $\alpha$=85° on the flat substrate 15 of the fully deployed configuration 65. In other examples, $\alpha$ may be between 82°-89°. FIGS. 6B through 6E, with reference to FIGS. 1A through 6A, illustrate the folding of the antenna 70 across several fold angles, $\beta$, which is the angle the substrate 15 makes with the xy-plane (as denoted in FIG. 6A), such that $\beta$=0° corresponds to the flat, fully deployed configuration 65 of FIG. 6A and $\beta$=90° corresponds to the fully folded, stowed configuration 60 of FIG. 1C, for example. FIG. 6B depicts the antenna 70 with $\beta$=10°. FIG. 6C depicts the antenna 70 with $\beta$=30°. FIG. 6D depicts the antenna 70 with $\beta$=60°. FIG. 6E depicts the antenna 70 with $\beta$=75°. In an example, FIG. 6A may correspond to position $P_1$, FIGS. 6B and 6C may correspond to position $P_2$, FIGS. 6D and 6E may correspond to position $P_3$, and FIG. 1C may correspond to position $P_4$, as described above.

Figure 7A:
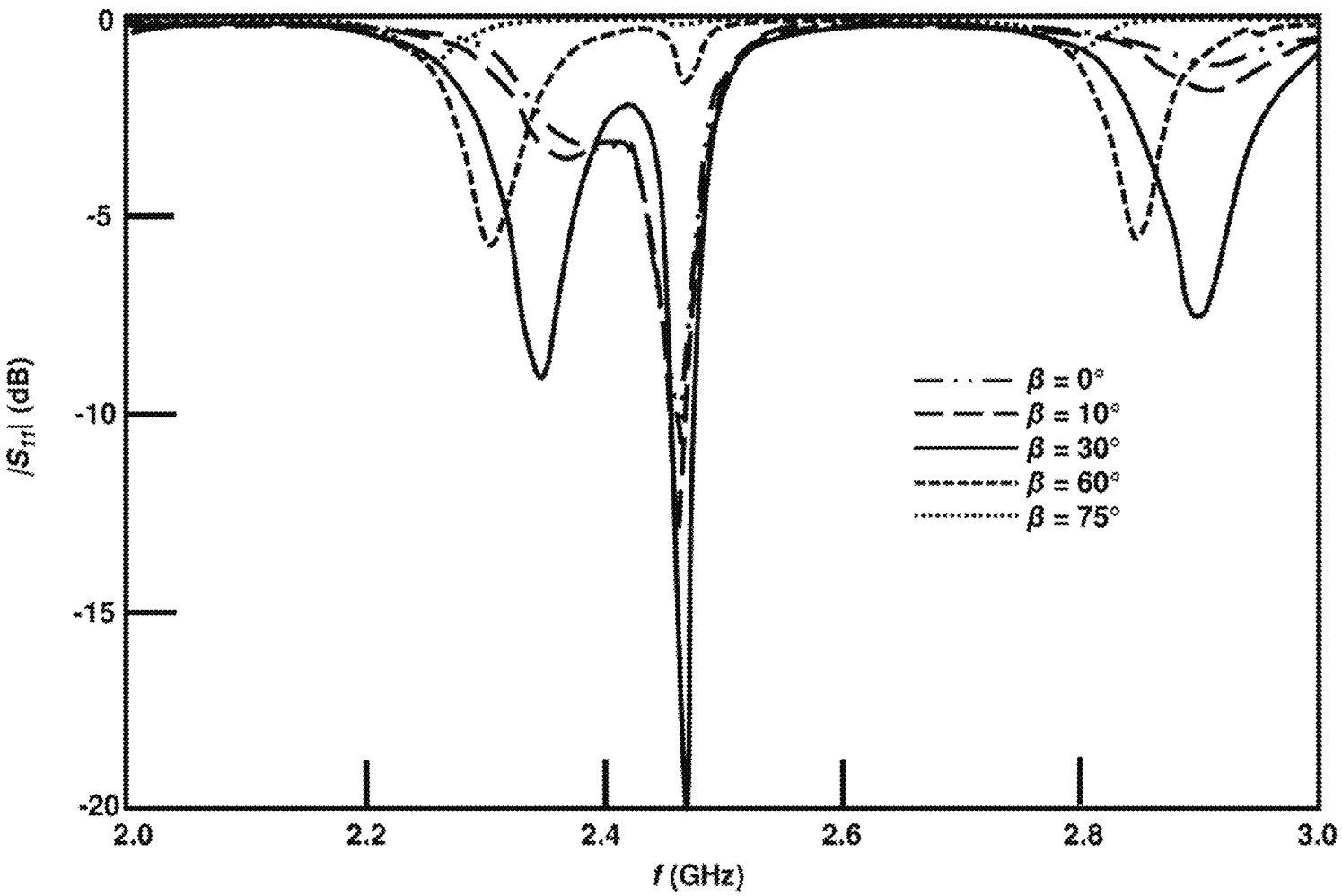
FIG. 7A is a graphical diagram illustrating the simulated magnitude of the input reflection coefficient of a folding antenna array for various fold angles, according to an embodiment herein.
Figure 7C:
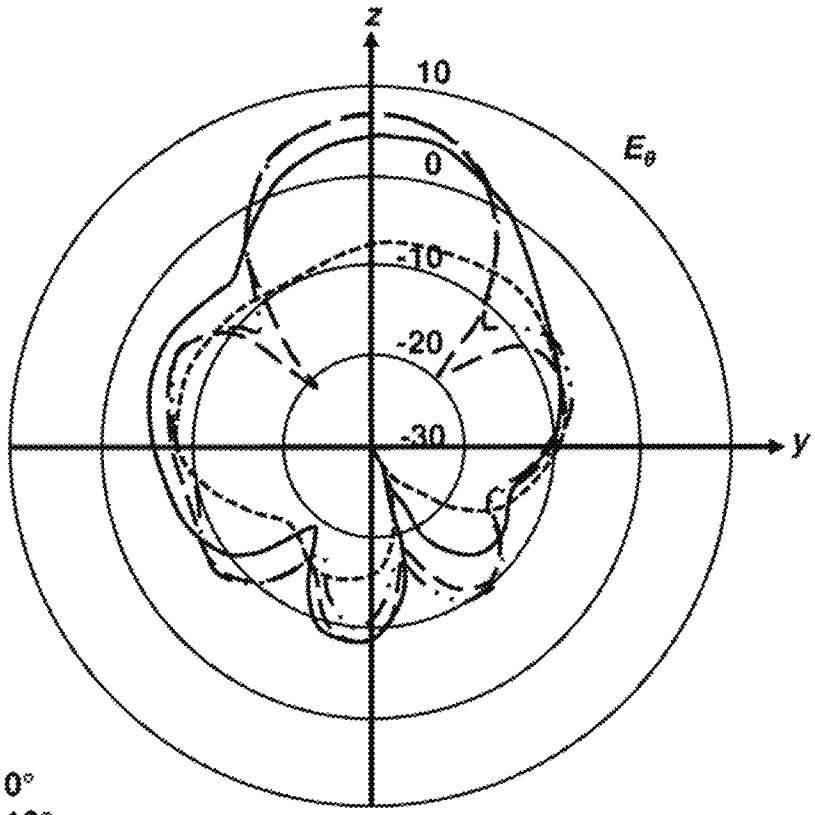
FIG. 7C is a graphical diagram illustrating simulated radiation patterns in the yz-plane for various fold angles of an antenna, according to an embodiment herein.
Figure 7B:
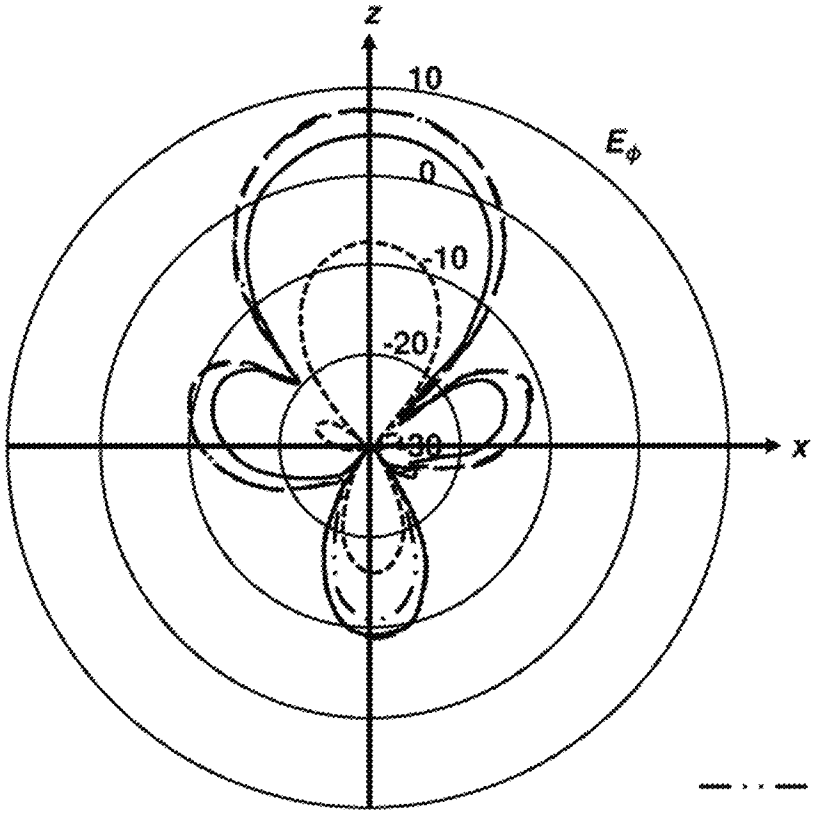
FIG. 7B is a graphical diagram illustrating simulated radiation patterns in the xz-plane for various fold angles of an antenna, according to an embodiment herein.

FIG. 7A, with reference to FIGS. 1A through 6E, illustrates the simulated magnitude of the input reflection coefficient ($S_{11}$) of the folding antenna 70 for intermediate fold angles $\beta$=0°, 10°, 30°, 60°, and 75°. FIGS. 7B and 7C, with reference to FIGS. 1A through 7A, illustrates the simulated desired polarization component (co-pol.) radiation patterns at 2.45 GHz in the xz-plane ($E_\phi$) and yz-plane ($E_\theta$), respectively, for $\beta$=0°, 10°, 30°, and 60° ($\beta$=75° is significantly detuned so its radiation pattern is omitted from FIGS. 7B and 7C). Considering the planar array as a benchmark, the results of FIGS. 7A through 7C indicate that the antenna 70 experiences a graceful degradation as the fold angle, $\beta$, increases. This is expected behavior, which further indicates that the antenna 70 provided by the embodiments herein is fully enabling and functional. From an impedance perspective, the bending of the electrical traces 35 causes loading that eventually detunes the impedance match. This is also seen in the radiation behavior, where a decrease in gain and increase in beamwidth can be observed in the yz-plane (FIG. 7C) as the antenna 70 folds through high fold angles. This behavior is less prevalent in the xz-plane (FIG. 7B) for the fold angles considered, but it will eventually manifest itself as the fold angle causes the antenna 70 to fold into its full compacted, stowed configuration 60.

Figure 8A:
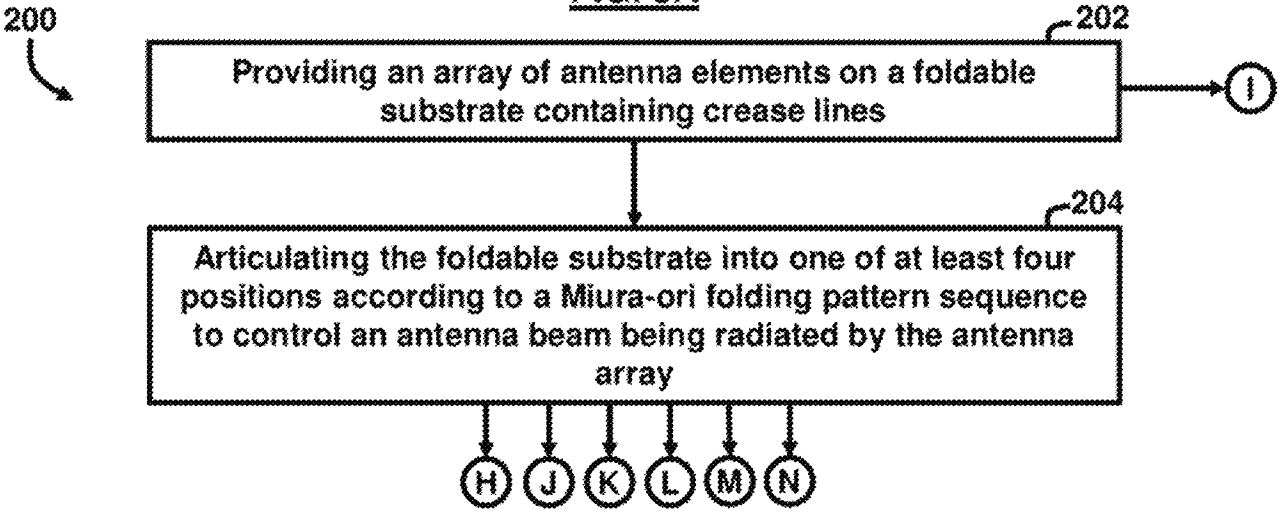
FIG. 8A is a flow diagram illustrating a method of controlling an antenna beam, according to an embodiment herein.

FIGS. 8A through 8H, with reference to FIGS. 1A through 7C are flow diagrams illustrating a method 200 of controlling an antenna beam 45. As shown in FIG. 8A, the method 200 comprises providing (202) an array 10 of antenna elements 30 on a foldable substrate 15 containing crease lines 20; and folding (204) the substrate 15 containing the array 10 of antenna elements 30 along crease lines 20 according to a one-step Miura-ori folding pattern sequence 40, wherein the folding changes an output radiation pattern 55 of an antenna beam 45 radiated from the array 10 of antenna elements 30.

Figure 8B:
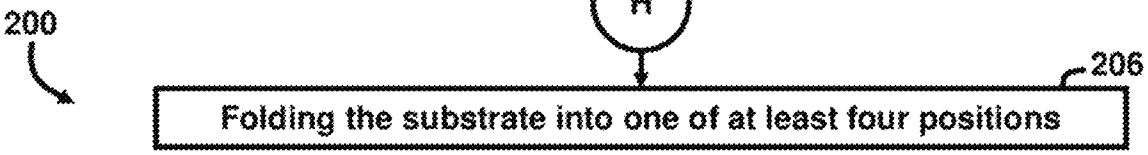
FIG. 8B is a flow diagram illustrating a method of folding a substrate of an antenna, according to an embodiment herein.
Figure 8C:
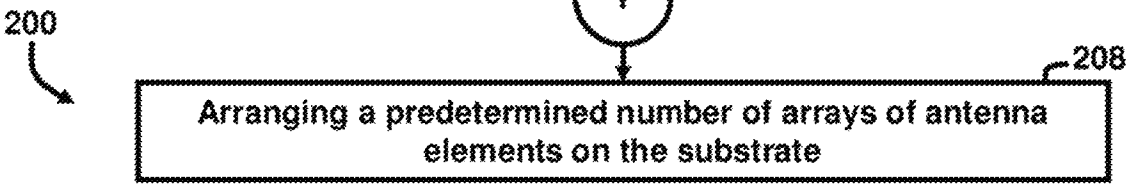
FIG. 8C is a flow diagram illustrating a method of arranging arrays of antenna elements on a substrate, according to an embodiment herein.
Figure 8D:
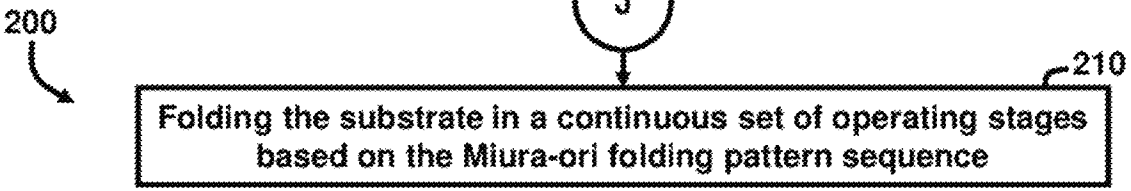
FIG. 8D is a flow diagram illustrating a method of folding a substrate based on a Miura-ori folding pattern sequence, according to an embodiment herein.
Figure 8E:
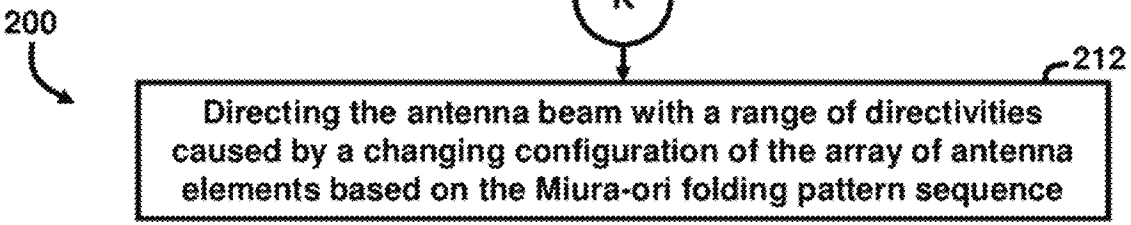
FIG. 8E is a flow diagram illustrating a method of directing an antenna beam with a range of directivities, according to an embodiment herein.
Figures 8F, 8G, 8H:
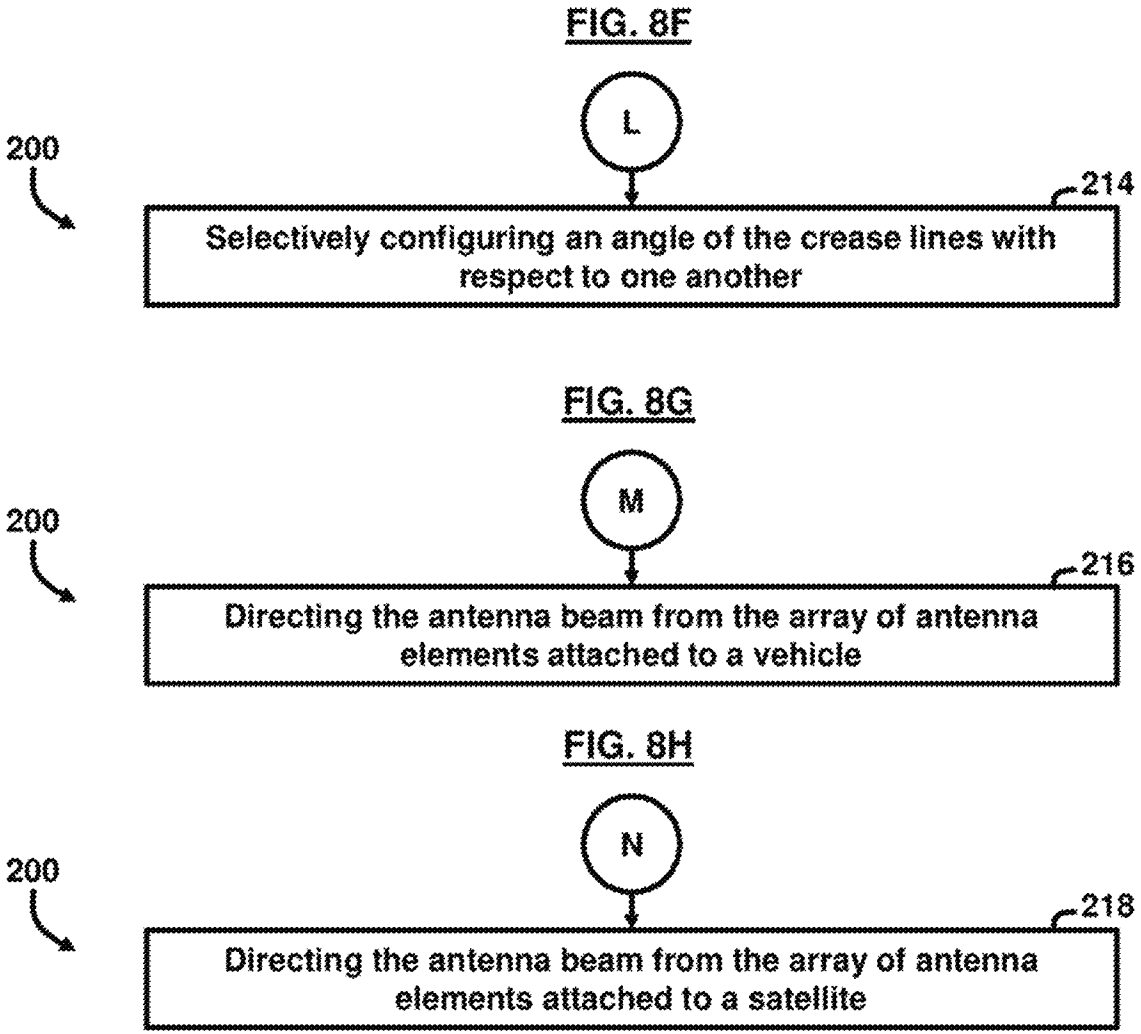
FIG. 8F is a flow diagram illustrating a method of configuring an angle of the crease lines of a substrate, according to an embodiment herein.
FIG. 8G is a flow diagram illustrating a first method of directing an antenna beam from an array of antennas, according to an embodiment herein.
FIG. 8H is a flow diagram illustrating a second method of directing an antenna beam from an array of antennas, according to an embodiment herein.

As shown in FIG. 8B, the method 200 may comprise folding (206) the substrate 15 into one of at least four positions. As shown in FIG. 8C, the method 200 may comprise arranging (208) a predetermined number of arrays (M×N) of antenna elements 30 on the substrate 15. As shown in FIG. 8D, the method 200 may comprise folding (210) the substrate 15 in a continuous set of operating stages based on the Miura-ori folding pattern sequence 40. As shown in FIG. 8E, the method 200 may comprise directing (212) the antenna beam 45 with a range of directivities 50 caused by a changing configuration of the array 10 of antenna elements 30 based on the Miura-ori folding pattern sequence 40. As shown in FIG. 8F, the method 200 may comprise selectively configuring (214) an angle of the crease lines 20 with respect to one another. As shown in FIG. 8G, the method 200 may comprise directing (216) the antenna beam 45 from the array 10 of antenna elements 30 attached to a vehicle 80. As shown in FIG. 8H, the method 200 may comprise directing (218) the antenna beam 45 from the array 10 of antenna elements 30 attached to a satellite 85.

Emerging performance requirements for high throughput electronic systems necessitate the need for adaptive antenna designs. Size and weight restrictions for these radiating systems in space and military applications, where portability and weight constraints are crucial, add additional constraints to the design. Antenna systems that can be folded into, and out of, compact physical states to save space allows for easier portability, transport, and deployment. Using origami folding techniques, the physical reconfiguration of these systems can be reduced to a single degree of actuation. This may eliminate the extra weight and space of more motors or actuators, but comes at the cost of the additional design complexity, limitations of material systems, and the impact of morphology on the desired electromagnetic performance. The embodiments herein address the latter of these potential design trade-offs by controlling the impact of the input impedance and beamforming capabilities using an origami-based foldable antenna array 10 based on the Miura-ori folding pattern 25.

The embodiments herein do not require hinges or other hardware to facilitate the folding of the antenna array 10, and do not utilize accordion-like spring configurations. However, the embodiments may utilize hinges or other hardware, if desired, to facilitate the folding of the antenna array 10 to ensure integrity of the antenna array 10 due to repetitive folding/un-folding causing mechanical fatigue of the antenna array 10 including the substrate 15 and/or conductive film 16. Furthermore, the embodiments herein do not utilize any phase shifters to provide for the tunability of the antenna beam 45, but rather uses the folding of the antenna 70 resulting in various positions (e.g., $P_1$-$P_4$) to provide for the tunability functionality. The antenna 70 possesses tunable gain and directivity through folding motions, allowing electromagnetic performance in multiple configurations. Further, the folding antenna 70 is scalable, enabling enhanced antenna beam 45 directivity and/or conforming to a non-flat surface of an underlying object.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Those skilled in the art will recognize that the embodiments herein can be practiced with modification within the spirit and scope of the appended claims.

What is claimed is:

1. An antenna array comprising:

a foldable substrate comprising a plurality of fold lines defining a plurality of facets and arranged in a Miura-ori folding pattern; and a plurality of antenna elements arranged in an M×N (row×column) pattern, with one antenna element on each facet, wherein M and N are positive integers, and interconnected by an electrical trace and disposed on the substrate, the plurality of fold lines separating each of the plurality of antenna elements, wherein one or more straight vertical fold lines divides and defines each of the columns (N), and a plurality of horizontal fold lines divides adjacent facets in each column and intersects the vertical fold lines at an angle of 82-89 degrees, and wherein each of the plurality of horizontal fold lines connects to a horizontal fold line from each adjacent column at a shared vertical fold line, wherein a plurality of connected horizontal fold lines forms a zigzag pattern, wherein the substrate containing the plurality of antenna elements is to fold according to a one-step Miura-ori folding pattern sequence between a stowed configuration and a deployed configuration, and wherein the plurality of antenna elements directs an antenna beam with a range of directivities caused by a selective folding of the substrate into one of at least four positions according to the one-step Miura-ori folding pattern sequence.

2. The antenna array of claim 1, wherein the plurality of antenna elements are non-overlapping prior to the folding of the substrate.

3. The antenna array of claim 1, wherein the antenna beam comprises a tunable radiation pattern that changes based on various stages of folding of the substrate containing the plurality of antenna elements.

4. The antenna array of claim 1, wherein the plurality of antenna elements are arranged in a predetermined array configuration that is selectively articulated in a continuous motion between a stowed configuration and a deployed configuration according to the Miura-ori folding pattern sequence.

5. The antenna array of claim 4, wherein the plurality of antenna elements is planar in the deployed configuration.

6. The antenna array of claim 1, wherein the plurality of antenna elements is incompressible.

7. A method of performing electrical beamforming of an antenna, the method comprising:

disposing a plurality of conductive antenna elements on a foldable substrate having a plurality of facets defined by fold lines to provide an antenna array, the plurality of antenna elements arranged in an M×N (row×column) pattern, with one antenna element on each facet, wherein M and N are positive integers, and interconnected by an electrical trace and disposed on the substrate, the plurality of fold lines separating each of the plurality of antenna elements, wherein one or more straight vertical fold lines divides and defines each of the columns (N), and a plurality of horizontal fold lines divides adjacent facets in each column and intersects the vertical fold lines at an angle of 82-89 degrees, and wherein each of the plurality of horizontal fold lines connects to a horizontal fold line from each adjacent column at a shared vertical fold line, wherein a plurality of connected horizontal fold lines forms a zigzag pattern;

radiating an antenna beam from the antenna array; and articulating the foldable substrate into one of at least four positions according to a Miura-ori origami folding pattern sequence to control an antenna beam being radiated by the antenna array.

8. The method of claim 7, wherein a frequency of the antenna beam is corresponds to a length of each of the conductive antenna elements.

9. The method of claim 7, wherein a surface area of a fully folded configuration of the antenna array is at least 70% less than the surface area of a fully deployed configuration of the antenna array.

10. The method of claim 7, comprising changing an output radiation pattern of the antenna beam based on the Miura-ori origami folding pattern sequence.

11. The method of claim 7, comprising actuating the Miura-ori origami folding pattern sequence using an actuator.

12. The method of claim 7, comprising folding the substrate containing the antenna array in a single degree of freedom motion.

13. A method of controlling an antenna beam, the method comprising: providing an array of antenna elements on a foldable substrate containing crease lines, the crease lines defining a plurality of facets, a plurality of antenna elements arranged in an M×N (row×column) pattern, with one antenna element on each facet, wherein M and N are positive integers, and interconnected by an electrical trace and disposed on the substrate, the plurality of crease lines separating each of the plurality of antenna elements, wherein one or more straight vertical crease lines divides and defines each of the columns (N), and a plurality of horizontal crease lines divides adjacent facets in each column and intersects the vertical crease lines at an angle of 82-89 degrees, and wherein each of the plurality of horizontal crease lines connects to a horizontal crease line from each adjacent column at a shared vertical crease line, wherein a plurality of connected horizontal crease lines forms a zigzag pattern; and folding the substrate containing the array of antenna elements along crease lines according to a one-step Miura-ori folding pattern sequence, wherein the folding changes an output radiation pattern of an antenna beam radiated from the array of antenna elements; and folding the substrate into one of at least four positions.

14. The method of claim 13, comprising arranging a predetermined number of arrays of antenna elements on the substrate.

15. The method of claim 14, comprising folding the substrate in a continuous set of operating stages based on the Miura-ori folding pattern sequence.

16. The method of claim 13, comprising directing the antenna beam with a range of directivities caused by a changing configuration of the array of antenna elements based on the Miura-ori folding pattern sequence.

17. The method of claim 13, comprising selectively configuring an angle of the crease lines with respect to one another.

18. The method of claim 13, comprising directing the antenna beam from the array of antenna elements attached to a vehicle.

19. The method of claim 13, comprising directing the antenna beam from the array of antenna elements attached to a satellite.

* * * * *